US005752215A

United States Patent [19]

Zaaiman et al.

[11] Patent Number: 5,752,215

[45] Date of Patent: May 12, 1998

[54] APPARATUS AND METHOD FOR CLASSIFYING VEHICLES USING ELECTROMAGNETIC WAVES AND PATTERN RECOGNITION

[75] Inventors: Ben Thomas Zaaiman; Paul-Boer Putter, both of Pretoria, South Africa; Pieter Johannes Erasmus Vermeulen, Hillsboro, Oreg.; Gerrit Jacobus Loubser, Kemtonpark, South Africa

[73] Assignee: Livingstone Legend Enterprises (Propiretary) Ltd., Lynnwood, South Africa

[21] Appl. No.: 606,566

[22] Filed: Feb. 26, 1996

[30] Foreign Application Priority Data

| | | | |
|---|---|---|---|
| Feb. 28, 1995 | [ZA] | South Africa | 95/1638 |
| Sep. 29, 1995 | [ZA] | South Africa | 95/8220 |

[51] Int. Cl.[6] ..... G08G 1/015; G08G 1/04

[52] U.S. Cl. ..... 701/117; 340/935; 340/942

[58] Field of Search ..... 364/436, 437, 364/438; 340/933, 934, 935, 942; 701/117, 118, 119

[56] References Cited

U.S. PATENT DOCUMENTS

| | | | |
|---|---|---|---|
| 2,419,099 | 4/1947 | Wall . | |
| 3,056,106 | 9/1962 | Hendricks . | |
| 3,436,540 | 4/1969 | Lamorlette . | |
| 3,737,851 | 6/1973 | Marshall et al. . | |
| 3,775,744 | 11/1973 | Cane . | |
| 4,247,768 | 1/1981 | Elmer et al. . | |
| 4,789,941 | 12/1988 | Numberg | 364/436 |
| 4,839,480 | 6/1989 | Bickley . | |
| 4,901,334 | 2/1990 | Gibson . | |
| 4,947,353 | 8/1990 | Quinlan, Jr. . | |
| 5,008,666 | 4/1991 | Gebert et al. | 340/936 |
| 5,101,200 | 3/1992 | Swett . | |
| 5,107,250 | 4/1992 | Pykett | 340/566 |
| 5,166,681 | 11/1992 | Bottesch et al. . | |
| 5,173,692 | 12/1992 | Shapiro et al. | 340/943 |
| 5,250,769 | 10/1993 | Moore . | |
| 5,296,852 | 3/1994 | Rathi | 340/933 |
| 5,337,257 | 8/1994 | White | 364/554 |
| 5,360,953 | 11/1994 | Reed . | |
| 5,367,475 | 11/1994 | White | 364/724.01 |
| 5,392,034 | 2/1995 | Kuwagaki | 340/933 |
| 5,420,794 | 5/1995 | James | 364/436 |
| 5,434,927 | 7/1995 | Brady et al. | 382/104 |
| 5,446,291 | 8/1995 | Becker et al. | 250/559.24 |
| 5,477,217 | 12/1995 | Bergan | 340/933 |
| 5,485,520 | 1/1996 | Chaum et al. | 380/24 |
| 5,486,820 | 1/1996 | Chatigny et al. | 340/933 |
| 5,519,784 | 5/1996 | Vermeulen et al. | 382/100 |
| 5,546,188 | 8/1996 | Wangler et al. | 356/376 |
| 5,587,575 | 12/1996 | Leitner et al. | 235/384 |
| 5,590,217 | 12/1996 | Toyama | 382/104 |

FOREIGN PATENT DOCUMENTS

| | | |
|---|---|---|
| 2690519 | 10/1993 | France . |
| DD291417 A5 | 10/1983 | Germany . |
| 4240789 | 9/1994 | Germany . |
| 881721 | 11/1961 | United Kingdom . |
| 1204484 | 9/1970 | United Kingdom . |
| WO 92/21132 | 11/1992 | WIPO . |
| WO 9325989 | 12/1993 | WIPO . |

*Primary Examiner*—Jacques H. Louis-Jacques
*Assistant Examiner*—Edward J. Pipala
*Attorney, Agent, or Firm*—William Squire

[57] ABSTRACT

Apparatus and a method for classifying objects moving in a defined range 18 within an operational region is disclosed and claimed. The apparatus finds particular application as a vehicle counter 10. The apparatus is mounted adjacent a road 18 and utilizes a distance-finder 12 to obtain a sequence of distance data relating to a vehicle passing on the road. The distance data and time data are utilised by a signal generator 34 to generate on two-dimensional pattern, wherein one dimension is time and the other is distance, representing the vehicle in the range. A filter filters out data relating to objects falling outside the range, thereby to limit unwanted noise. A neural net 38 classifies the pattern according to one of a plurality of classes, including direction of travel. Counter 40 is used to count vehicles classified as moving in direction A or direction B.

22 Claims, 16 Drawing Sheets

APPARATUS AND METHOD FOR CLASSIFYING VEHICLES USING ELECTROMAGNETIC WAVES AND PATTERN RECOGNITION

INTRODUCTION AND BACKGROUND

THIS invention relates to object sensors and more particularly to apparatus for detecting vehicles on a road and for classifying their movement, including counting vehicles travelling in any direction.

The applicant is aware of a variety of kinds of vehicle counters. These include counters comprising pressure sensitive strips or inductive loops mountable in a road surface to detect vehicles; overhead video cameras and barrier arrangements; and also roadside mounted barrier sensors. Of the latter kind, known arrangements include arrangements adapted to detect specific targets such as bar code arrangements applied to the sides of passing vehicles (co-operative targets); and arrangements wherein transmitters are mounted on one side of the road and associated detectors or sensors are mounted on the other side of the road. The setting-up of these arrangements is difficult and time consuming and "noise" generated by other objects, either in the foreground or background which are not of interest, such as pedestrians, often cause reliability problems.

OBJECT OF THE INVENTION

Accordingly it is an object of the present invention to provide an alternative system and method with which the applicant believes the aforementioned disadvantages of the known arrangements may at least be alleviated.

SUMMARY OF THE INVENTION

According to the invention there is provided apparatus for classifying movement of an object moving in a defined range within an operative region, the apparatus comprising:

distance-finding means mountable adjacent said operative region;

the distance-finding means comprising transmitter means for transmitting beams of electromagnetic waves in at least one field extending through said operative region; receiver means located adjacent said transmitter means for receiving reflections of said beams from regions on an object moving in said operative region through said field, to determine from said reflections the presence or absence of the object in said range, and a data output for data relating to presence or absence of the object in said range, said moving object being representative of one of a plurality of different classes; controller means connected to the distance-finding means for causing the distance-finding means over a period of time to illuminate regions on the object with the beams and to determine from reflections of the beams from the regions a sequence of data relating to the presence or absence of the object in the range as the object moves along the operative region and for gathering data relating to the time relation of the sequence of data;

the controller comprising signal generating means for generating a multi-dimensional pattern representing the said object moving along the region; and pattern recognition means connected to the signal generating means to receive as an input said pattern and for classifying the pattern according to one of said plurality of different classes and for providing a corresponding output signal.

In one form of the apparatus according to the invention the distance-finding means, in use, determines from said reflections the distance of said regions from a reference adjacent the region and the said data relating to presence or absence of the object comprises a sequence of distance data relating to the distance of the regions from the reference as the object moves through the field; and the said multi-dimension pattern has a first dimension in the time domain and a second dimension comprising distance from the reference.

The said defined range may extend between a first boundary and a second boundary and the apparatus preferably comprises filter means for filtering out data relating to reflections received from objects beyond the second boundary, constituting a maximum range, in use, of a range gate of the distance-finding means. The maximum range may be adjustable, for example software adjustable.

Preferably the distance-finding means is located spaced from the said first boundary and the apparatus may comprise filter means for filtering out data relating to reflections received from objects between the distance-finding means and said first boundary, constituting a minimum range, in use, of the range gate.

The apparatus is particularly suitable for use as a vehicle counter.

In such an application it may be mounted adjacent a first side of a road and in use classifies vehicles according to type or size, the direction of travel, speed, etc. The first and second sides of the road may constitute the first and second boundaries of the range and the filter means ensures that reflections from objects between the apparatus and the first side is filtered out as well as reflections from objects beyond the second side, thereby to reduce noise-like signals reflected by pedestrians, stationary objects and moving objects in regions which are not of interest.

The distance-finding means may utilise time of flight of a pulse transmitted by the transmitter means towards a region on the object from where it is reflected and back to the receiver means, to determine the distance of the region from the reference. The reference may be the position of the distance-finding means and other methods of determining the distance from the distance-finding means may also be utilised.

The apparatus may further comprise segmentation means connected to said signal generating means to receive said multi-dimensional pattern as an input and for segmenting the pattern into classifiable events.

The segmentation means may segment the pattern by fitting geometrical masks onto the pattern. These masks may be designed to take into consideration criteria such as a maximum expected spacing within classifiable event patterns and a maximum expected variation in distance of the pattern.

The pattern recognition means preferably comprises a neural net.

In a first embodiment of the apparatus according to the first form of the invention the transmitter means comprises a single transmitter for transmitting beams in a single field a centre axis of which is at an angle of less than 90° relative to an elongate axis of the operative region.

In a second embodiment of the apparatus according to the first form of the invention the transmitter means may comprise first and second transmitters and the receiver means may comprise first and second receivers constituting first and second transmitter and receiver pairs, the pairs being spaced from one another to transmit beams in first and second fields having a first and a second centre axis respectively, the first and second axes being substantially parallel to one another and substantially perpendicular to an elongate axis of the operative region, and the signal generating means may generate the multi-dimensional pattern from data received from both said first and second pairs.

The first and second transmitter and receiver pairs may be mounted on an elongate member, the member being mounted in a housing and the housing may be mountable on a support structure next to a road with the member extending substantially parallel to the road.

The housing may comprise a back plate assembly supporting a circular cylindrical sleeve; the elongate member may be circular cylindrical in configuration and may be mounted for rotation about its own longitudinal axis in the sleeve, thereby to adjust the elevation of the first and second transmitter and receiver pairs; and the apparatus may further comprise means for securing the member in a selected position relative to the sleeve.

The back plate assembly may comprise a saddle arrangement for abutting against a support on which the back plate is mounted. The saddle arrangement may define a slot having a bell-shaped profile.

The housing may comprise a cover which is removably mountable on the back plate and the cover may define a window region for the first and second transmitter and receiver pairs.

In a second form of the apparatus according to the invention the transmitter means may comprise first and second transmitters and the receiver means may comprise first and second receivers constituting first and second transmitter and receiver pairs, the pairs being spaced from one another to transmit beams in first and second fields having first and second centre axes respectively extending transversely to an elongate axis of the operative region; and the signal generating means may generate from data received from both the first and second pairs the multi-dimensional pattern, having a first dimension in the time domain and a second dimension comprising transmitter and receiver pair index.

According to another aspect of the invention there is provided a method of classifying objects moving in a defined range within an operative region, the method comprising the steps of:

providing distance-finding means adjacent said operative region;

causing the distance-finding means to illuminate an object moving in the operative region with a sequence of transmitted pulses; said object being representative of one of a plurality of different classes;

receiving reflections of said pulses at said distance-finding means;

generating a multi-dimensional pattern representing the said object moving in the range;

classifying said pattern according to one of said plurality of different classes; and providing a corresponding output signal.

The method may include the step of determining from said transmitted pulses and said reflections distance of regions on the object from a reference, and the step of generating a multi-dimensional pattern may comprise generating a two dimensional pattern representing the object having a first dimension in the time domain and a second dimension comprising distance from the reference.

In another form of the method the operative region may be divided into at least a first and a second range; said distance-finding means may comprise at least first and second transmitter and receive pairs utilised to illuminate the object and to receive reflections, said pulses and said reflections may be utilised to determine whether the object is in said first or said second range and the step of generating a multi-dimensional pattern may comprise generating a three dimensional pattern representing the object and which representation has a first dimension in the time domain, a second dimension comprising transmitter receiver pair index and a third dimension comprising range index.

BRIEF DESCRIPTION OF THE ACCOMPANYING DIAGRAMS

The invention will now further be described, by way of example only, with reference to the accompanying diagrams wherein.

DESCRIPTION OF PREFERRED EMBODIMENTS OF THE INVENTION

Figure 1:
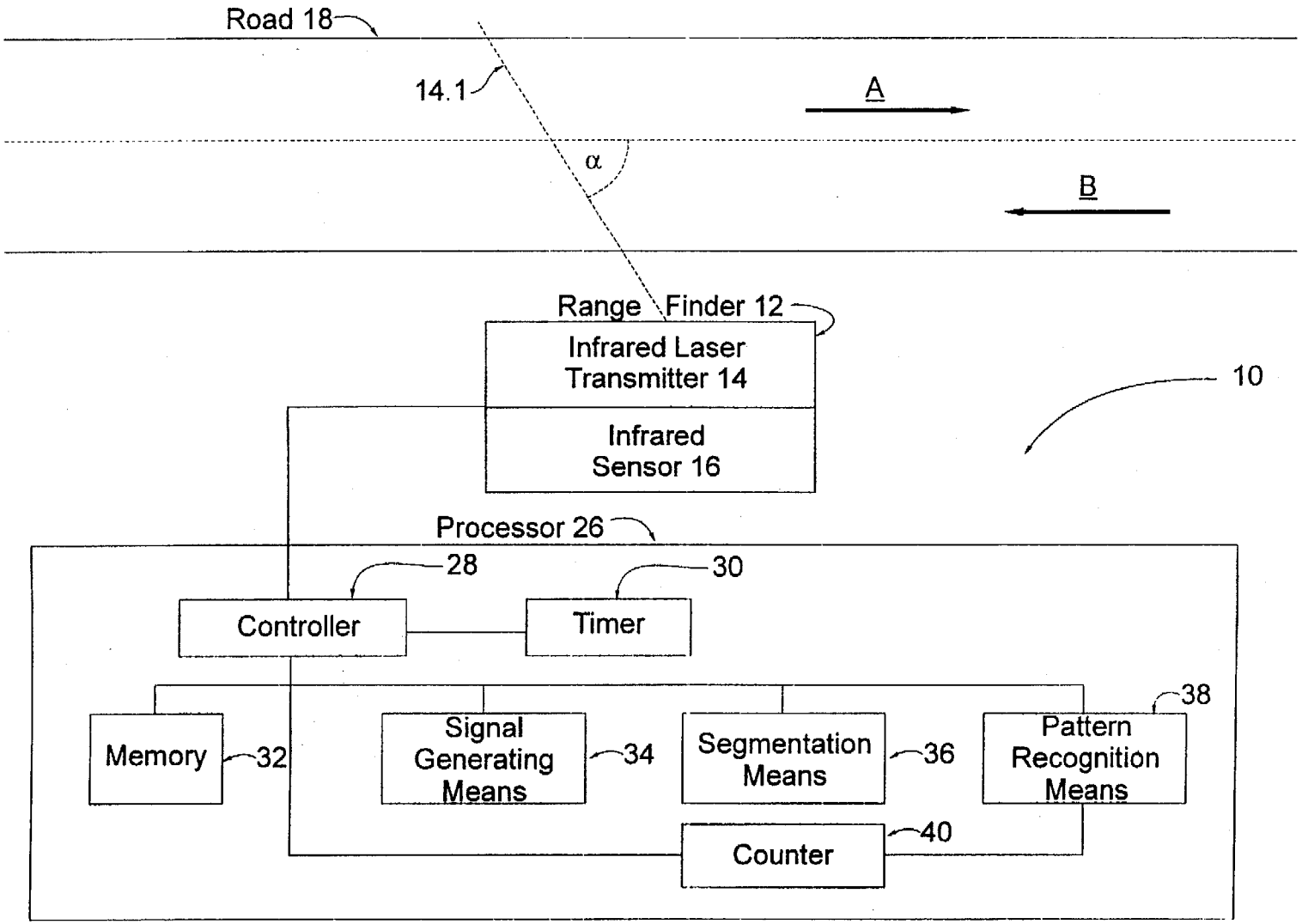
FIG. 1 is a block diagram of a first embodiment of a vehicle counter according to the invention.

In FIG. 1 there is shown a block diagram of a first embodiment of a vehicle counter system according to the invention generally designated by the reference numeral 10.

The system 10 comprises a distance-finder 12 in the form of an infra-red laser transmitter or emitter 14 mounted next to a road 18, so that it emits a pulse train of infra-red beams 14.1 in a stationary field extending across the road and having a centre axis at an angle ($\alpha$) with the line of travel of vehicles (not shown) on the road. The angle ($\alpha$) is smaller than 90°. The distance-finder 12 further comprises a suitable infra-red receiver or sensor 16 located immediately adjacent the emitter 14 for cooperating with the transmitter by receiving reflections from objects on the road 18 of the transmitted beams. The road 18 represents a defined range within a larger operative region which may further include sidewalks and adjacent lanes.

Figure 2:
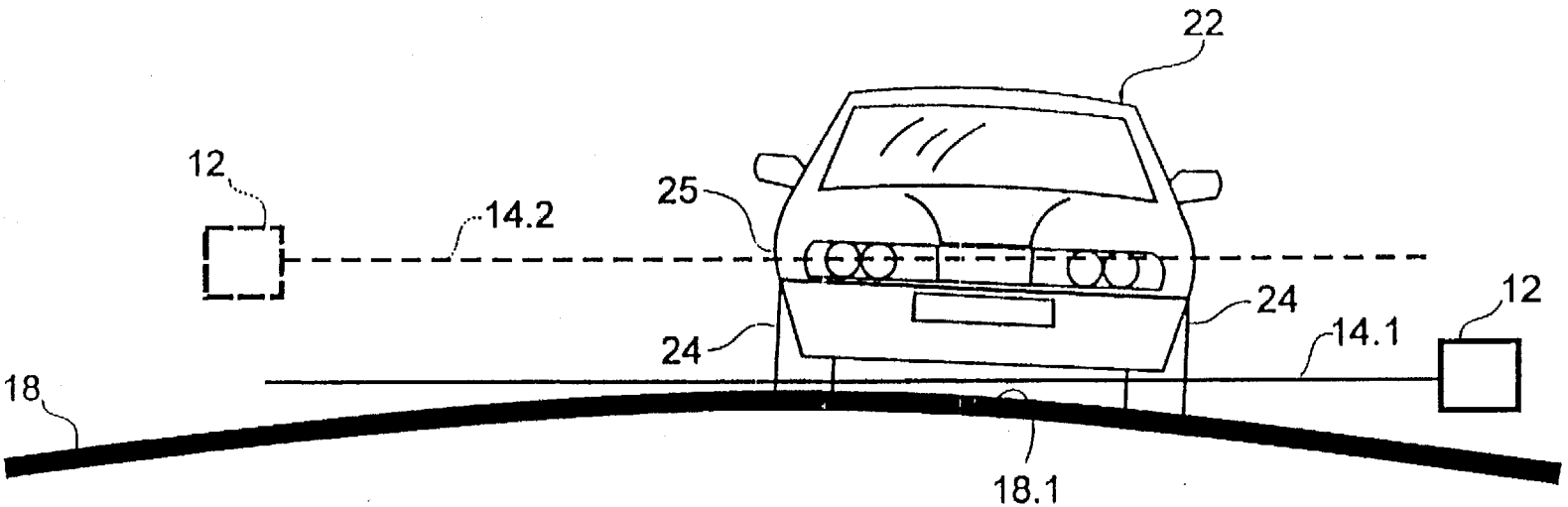
FIG. 2 is a view along the length of a road illustrating traffic on the road and two possible heights for a distance-finding beam transmitted by the apparatus of the first embodiment.

As best shown in FIG. 2, in terms of their height, the beams 14.1 may be transmitted in the clearance region between a top region of the road surface 18.1 and the chassis of vehicles 22 travelling on the road, so that, in use, the beams 14.1 are interrupted by the wheels 24 only, of passing traffic. Alternatively, the beams may be transmitted at a higher level, to illuminate regions on the body of the vehicle, as shown with beam 14.2 in FIG. 2.

As shown in FIG. 1, the system 10 further comprises a processor 26 comprising a controller 28 interfaced with the distance-finder 12. Connected to the controller 28 are a timer 30, a memory arrangement 32, signal generating means 34 for generating a two-dimensional pattern (as will be described hereinafter), pattern segmentation means 36, pattern recognition means 38 (preferably in the form of a neural net) and a counter 40 also connected to the output of the pattern recognition mean 38.

Figure 3:
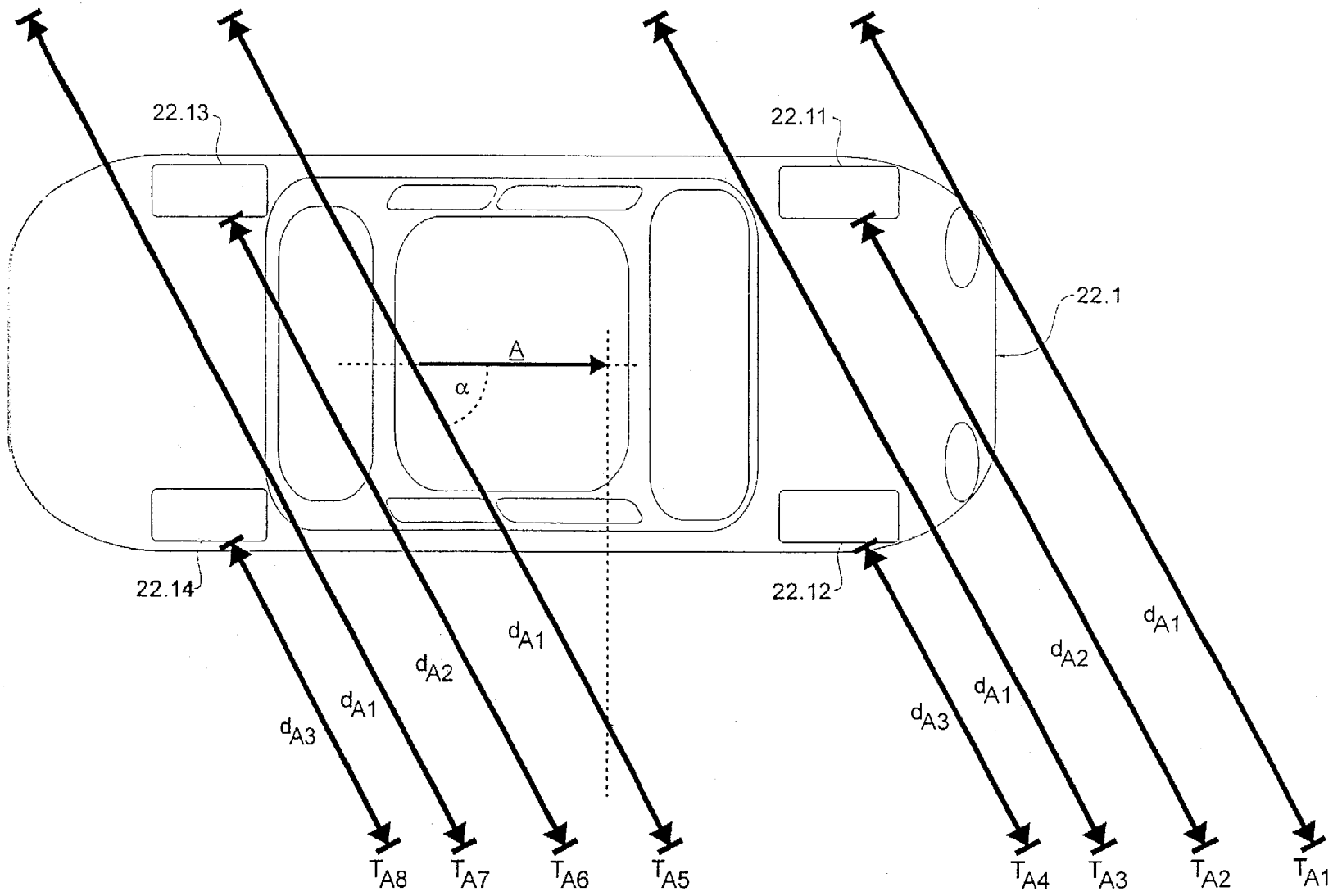
FIG. 3 is a plan view of a vehicle moving in a first direction through a stationary field wherein beams are transmitted by the apparatus of the first embodiment and illustrating illumination of the wheels only of the vehicle over a period of time.

The distance-finder 12 operates on a "time of flight" principle for an emitted beam and a reflection thereof back to the sensor 16. Referring to FIG. 3, with the stationary distance-finder set-up as hereinbefore described and vehicle 22.1 travelling in direction A past the stationary field, at $T_{A1}$, only background reflections at distance $d_{A1}$, are detected. At time $T_{A2}$, remote front wheel 22.11 reflects the beams 14.1 and a distance $d_{A2}$ from the distance-finder 12 for the wheel is measured. Thereafter and at time $T_{A4}$, the closer front wheel 22.12 reflects the beams and a distance $dA_3$ for the wheel 22.12 is measured. Still later on at time $T_{A6}$, the remote rear wheel 22.13 reflects the beams and distance $d_{A2}$ is measured and still even later, at time $T_{A8}$ the closer rear wheel 22.14 reflects the beams, and a distance $d_{A3}$ is measured.

Figure 5:
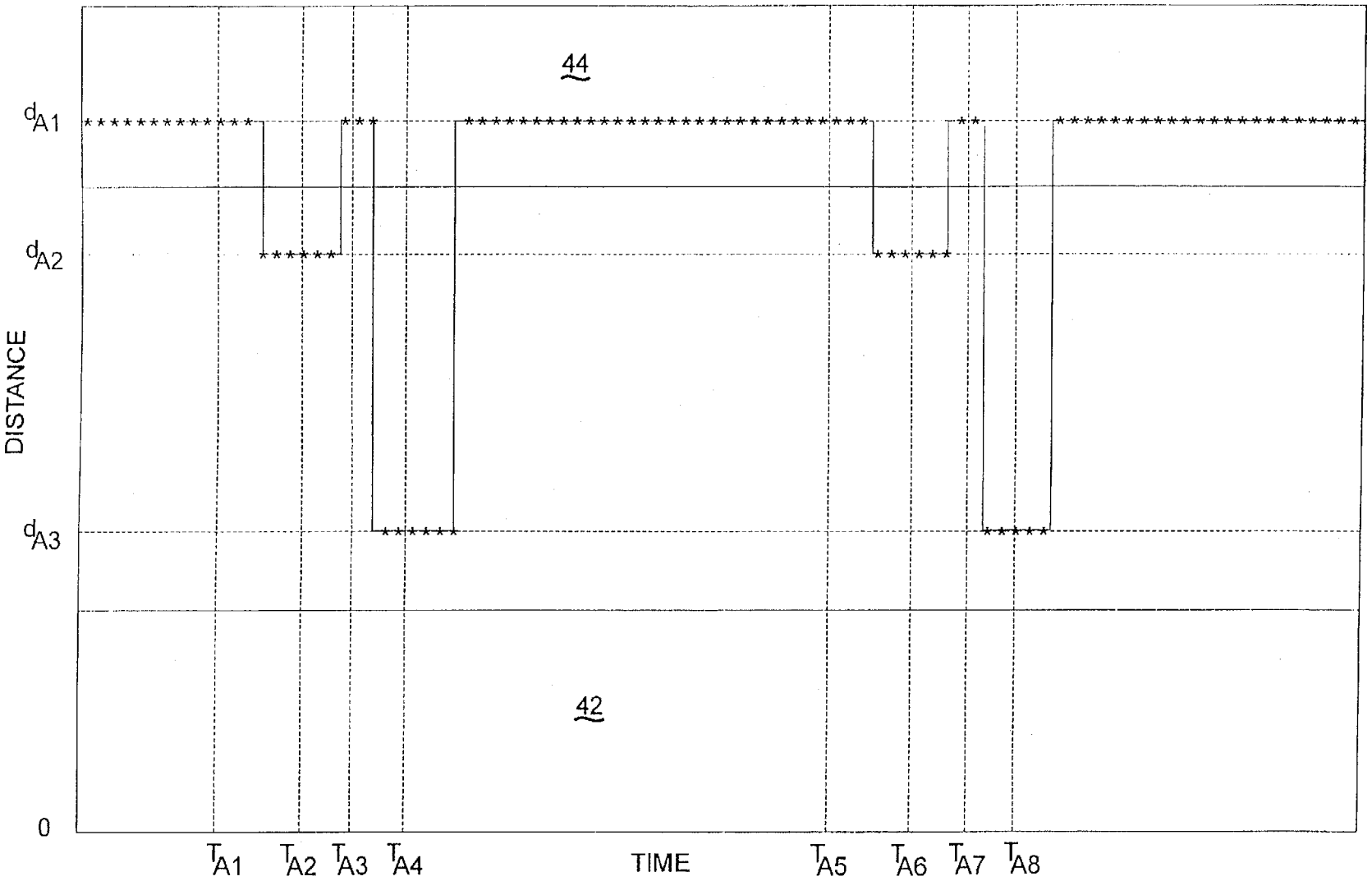
FIG. 5 is a two-dimensional pattern of the distance from the distance-finder of the wheels of the vehicle in FIG. 3 against time.

Processor 26 (shown in FIG. 1) and more particularly the signal generator 34 utilises the aforementioned time data ($T_{A1}$ to $T_{A8}$) and the aforementioned sequence of distance data ($d_{A1}$, $d_{A2}$ and $dA_3$) to generate a two dimensional pattern of the measured distance and time, in which pattern a first dimension is time and a second dimension is distance. This pattern, representing vehicle 22 moving in direction A along road 18, is diagrammatically shown in FIG. 5. It will be appreciated that since the vehicle is illuminated by a pulse train of beams, the pattern will also comprise a train of pixels indicated by the star-like characters in FIG. 5.

Filters may be applied to this representation to block out distance data relating to objects in regions that are not of interest. Such blocked out regions are shown at 42 and 44 in FIG. 5. In practice such blocked out regions may be regions on sidewalks and adjacent lanes of the road and thus in the larger operative region which are not of interest or which are covered by another similar system.

Figure 4:
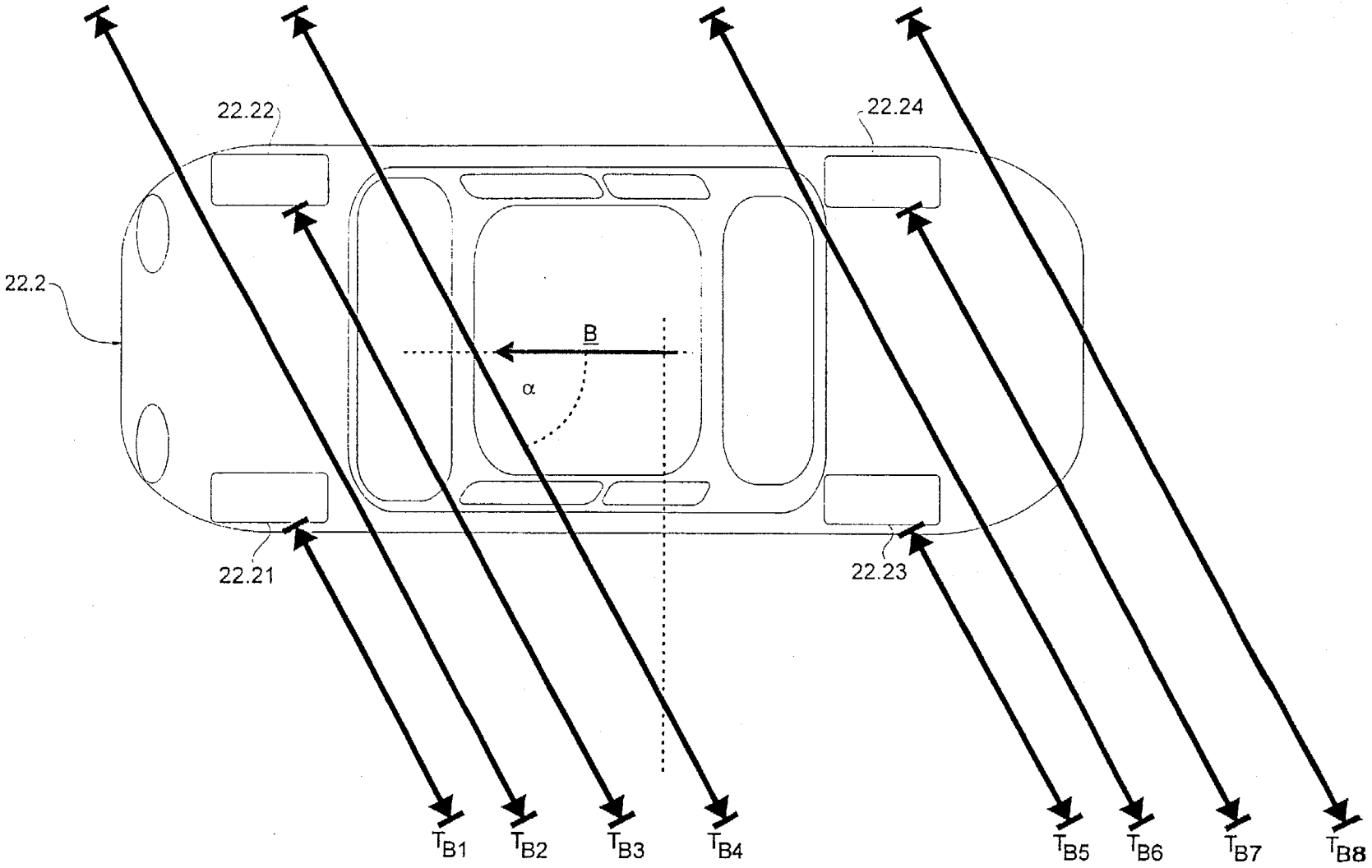
FIG. 4 is a view similar to FIG. 3, but with the vehicle moving in an opposite direction.
Figure 6:
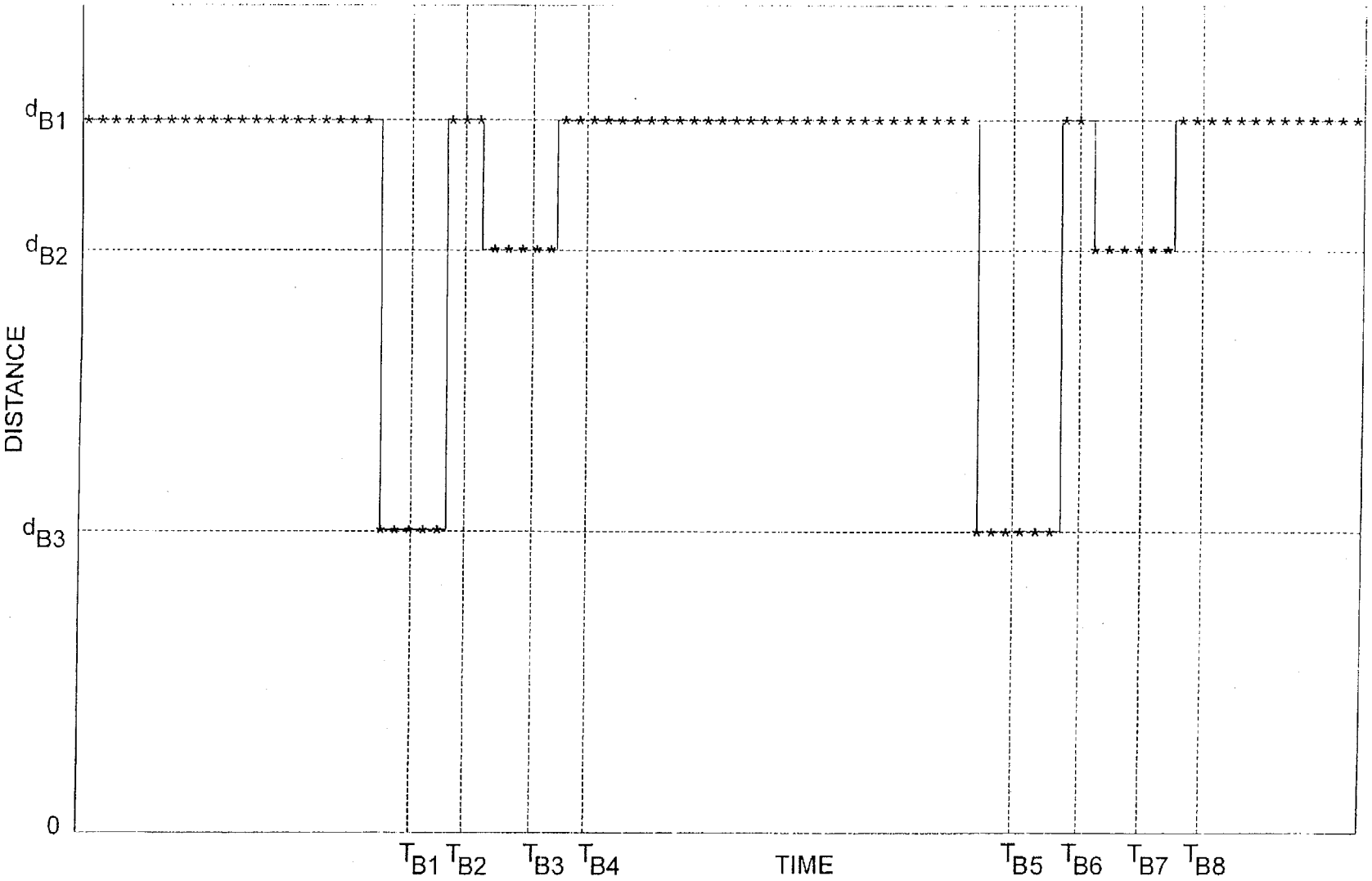
FIG. 6 is a pattern similar to the pattern in FIG. 5, but for the vehicle in FIG. 4.

In FIGS. 4 and 6, similar diagrams for a vehicle 22.2 travelling in direction B are shown. It will be appreciated that in this case the closer front wheel 22.21 first reflects the beams 14.1 and thereafter, in sequence, wheels 22.22, 22.23 and 22.24.

Figure 7:
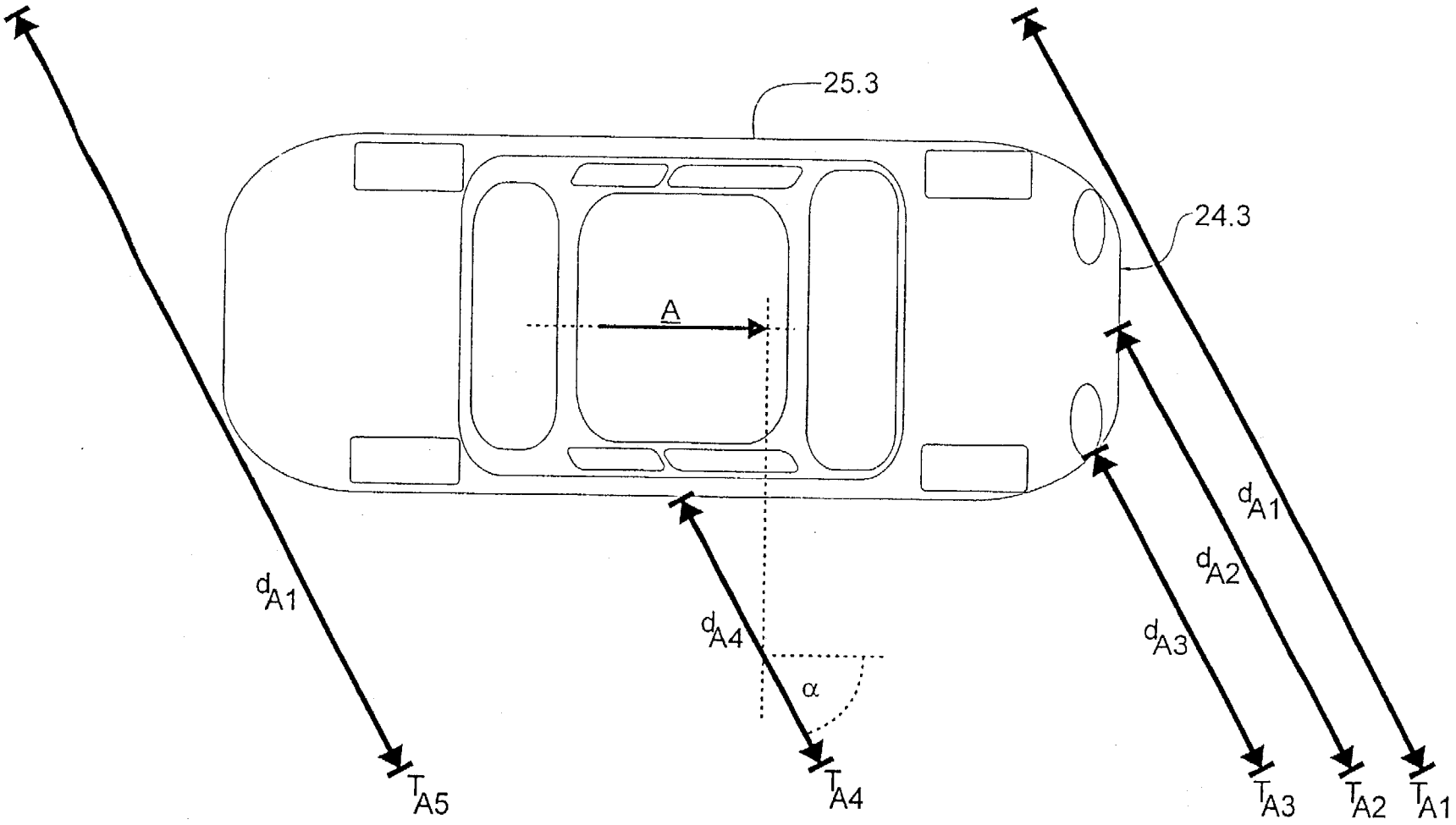
FIG. 7 is plan view of a vehicle moving in a first direction through the field of the apparatus of the first embodiment and illustrating illumination of various regions of the body of the vehicle.
Figure 8:
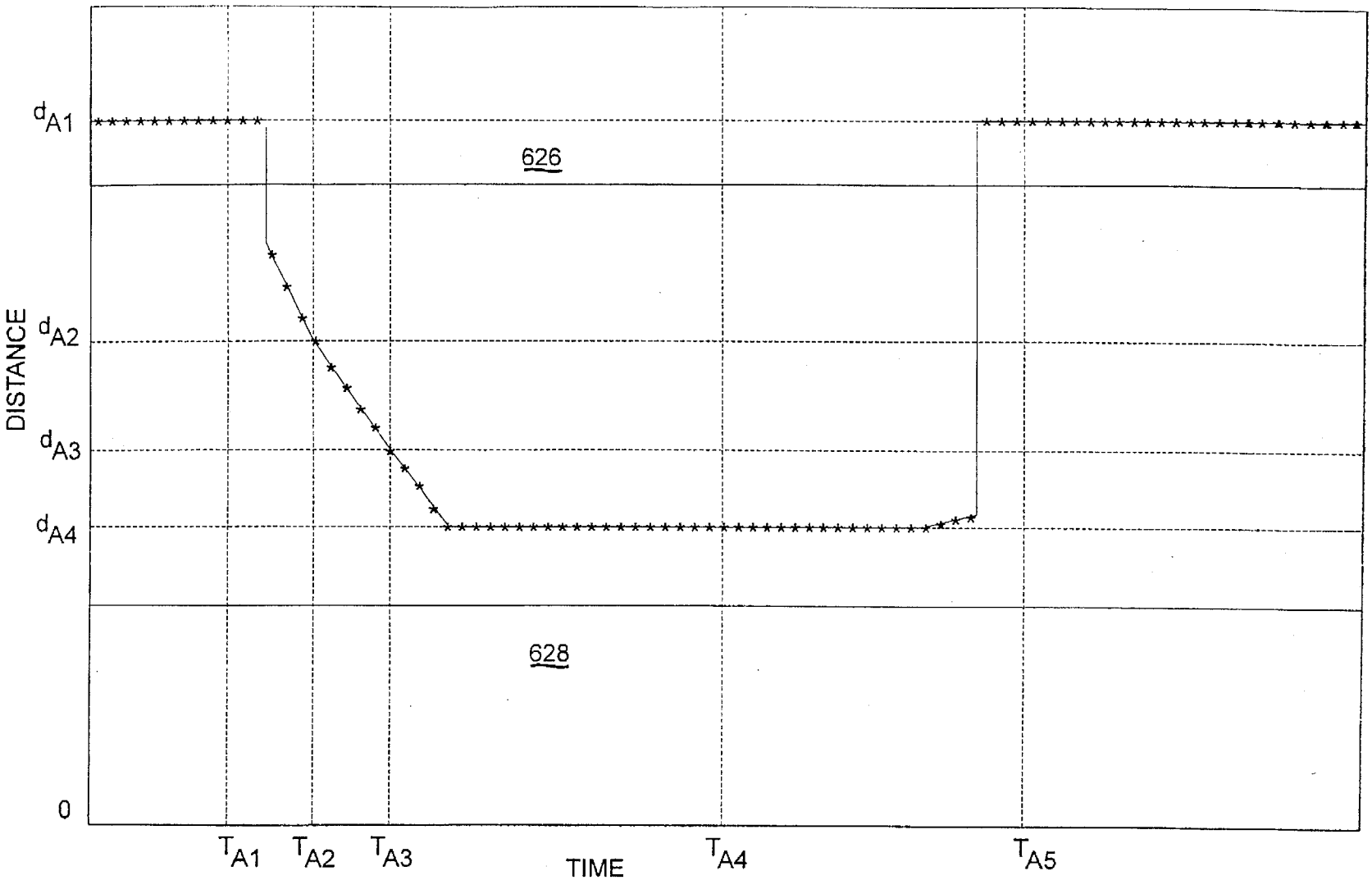
FIG. 8 is a two dimensional pattern of the distance from the distance-finder of the regions of the body of the vehicle in FIG. 7 against time.

In FIGS. 7 and 8, diagrams are shown for a case where the beams 14.2 (shown in FIG. 2) illuminate regions on the body 25.3 (shown in FIG. 7) of a vehicle 24.3 moving past the distance-finder.

In practice where many vehicles are passing past the distance-finder, a complex pattern representing all these vehicles moving past the distance-finder is generated. The complex pattern is fed as an input to the segmentation means 36 shown in FIG. 1. The segmentation means segments the complex pattern in classifiable events, by fitting properly designed geometrical masks onto the pattern. The mask sizes and shapes are a function of a number of variables which take cognisance of the expected distance between vehicles, the expected distance between wheels on the same axle of a vehicle, vehicle speed and thus time; and the expected distance between axles on vehicles.

The purpose of the segmentation of the pattern is to break the complex pattern down into events that would be classifiable by the neural net 38.

Figure 9:
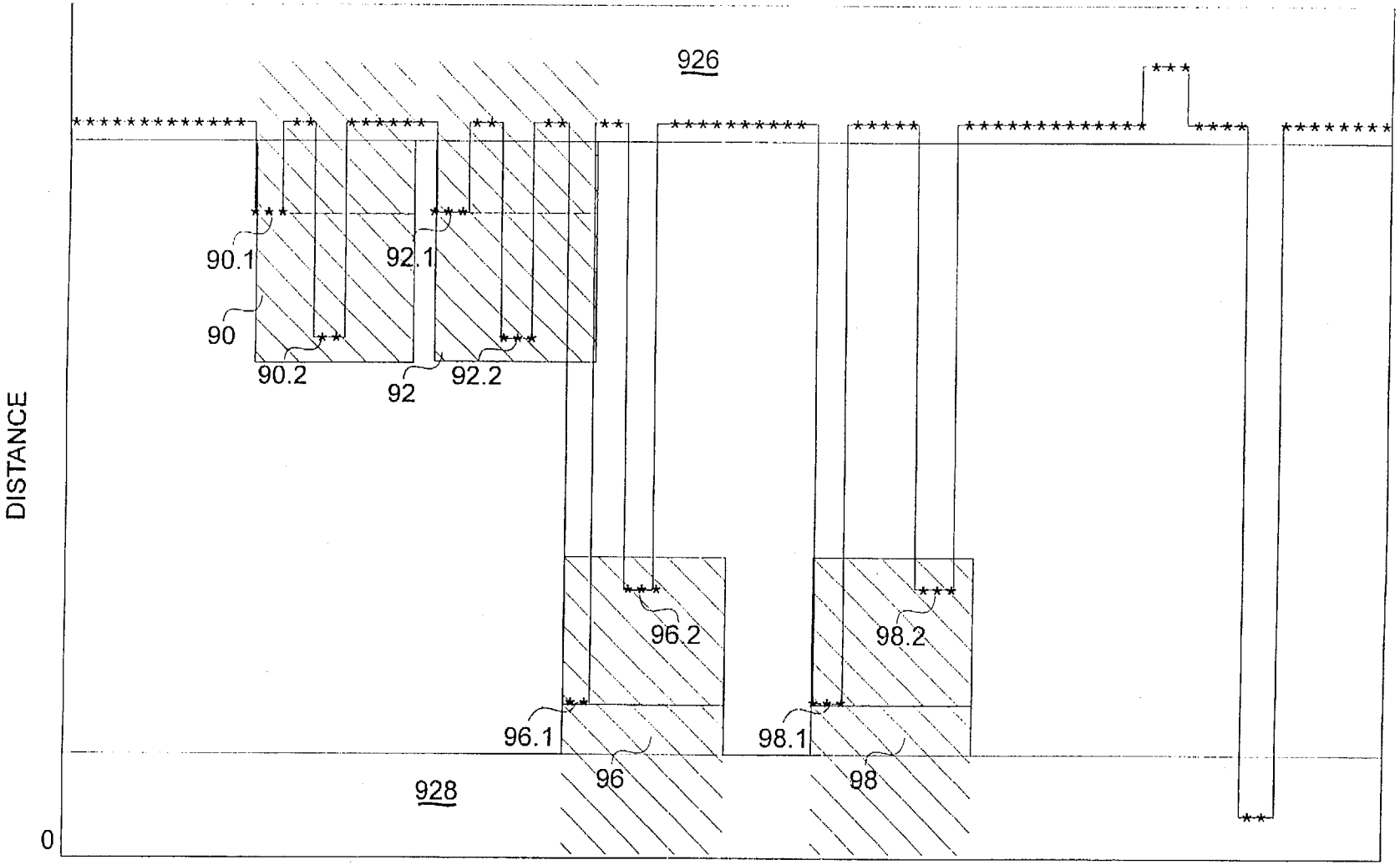
FIG. 9 is another typical two-dimensional pattern of the kind of FIGS. 5 and 6 illustrating geometrical masks fitted on the pattern by the apparatus according to the invention.

For example, in FIG. 9, mask 90 links the signals 90.1 and 90.2 on the basis of their relative distance and time spacing. Similarly mask 92 links signals 92.1 and 92.2, mask 96 links signals 96.1 and 96.2 and mask 98 links signals 98.1 and 98.2.

Features of these segments are extracted in known manner and are then fed to the neural net 38 (shown in FIG. 1) which is trained in known manner to classify signals similar to those in segments 90 and 92 as to have been caused by a vehicle with two axles, two wheels per axle and which vehicle travelled past the system in a first direction in a lane relatively far away from the distance-finder 12. Signals similar to those in segments 96 and 98 are classified to have been caused by another vehicle having two axles and two wheels per axle and which vehicle travelled in the opposite direction in a lane closer to the distance-finder.

It will be appreciated that the system according to the first embodiment of the invention with its single field having a centre axis extending at an angle of less than 90° relative to the line of travel of vehicles on the road can discriminate between vehicles travelling in the one or the opposite direction. The loading of the road can be determined in that not only the number of vehicles that travelled in a particular lane can be determined, but also the number of axles on the vehicle and the number of wheels on each axle. Furthermore, data relating to the speed of travelling of a vehicle may also be extracted based on the spacing of subsequent signals caused by the wheels of the vehicle.

Figure 10:
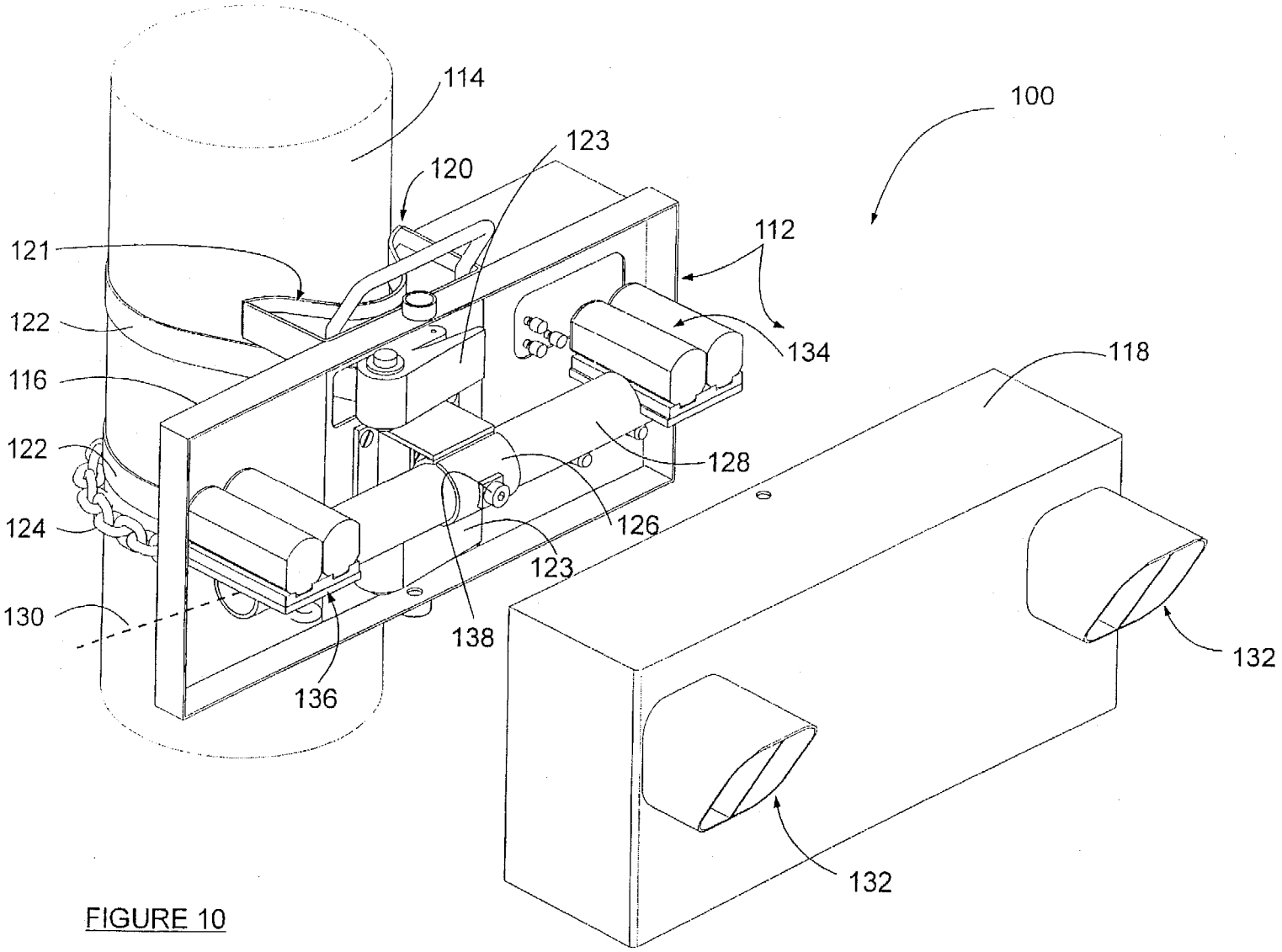
FIG. 10 is a diagrammatic perspective view, partially exploded, of mechanical components of a second embodiment of the apparatus according to the invention mounted on a post next to a road.

A second embodiment of the vehicle counter according to the invention will now be described with reference to FIGS. 10 to 14 wherein the counter is designated 100 in FIGS. 10 and 12. Whereas the first embodiment comprises a single transmitter receiver pair and utilises a single distance-finding field, the second embodiment 100 comprises two transmitter and receiver pairs and utilises two fields. The distance-finding beams are transmitted in first and second stationary fields having first and second centre axes respectively. The centre axes are substantially parallel to one another and substantially perpendicular to a centre line of a road, as will hereinafter be described.

The apparatus 100 comprises a housing 112 which is removably mountable on a support such as a vertically extending road side post 114, for example a utility pole. The housing 112 comprises a back plate assembly 116 and a removable cover 118. The back plate assembly comprises a saddle arrangement 120 having a bell-shaped profile 121 (also shown in FIG. 11) for facilitating stable and secure fastening of the back plate assembly on posts having a variety of outside profiles. In particular, the opposed linear regions 121.1 of length L which are spaced from apex 121.1 facilitate mounting of the assembly 116 on hexagonal and octagonal posts. When used with these posts, the linear regions 121.1 abut against flat surfaces on these posts. Straps 122 and tightening clamps 123 are used to secure the back plate assembly supported by the saddle arrangement 120 to the post. Chains 124 may also be provided to augment the fastening and to prevent theft of the apparatus.

On the back plate arrangement 116 there is provided a circular cylindrical sleeve 126. A circular cylindrical tube 128 supporting spaced first and second laser transmitter and receiver pairs 134 and 136 is mounted in sleeve 126. The first and second pairs are spaced a distance D apart on the tube 128. By rotating tube 128 about its own longitudinal axis 130, the elevation of transmitter and receiver pairs 134 and 136 may be adjusted manually. Screw 138 is used to secure the tube in a selected position to provide the desired elevation. After the aforementioned setting, the cover 118 is secured to the back plate assembly 116, to close the housing.

The cover 118 provides window regions 132 for the first and second transmitter and receiver pairs 134 and 136. In use, the housing is mounted on pole 114, so that the longitudinal axis of tube 128 is substantially parallel with a centre line 148.3 of road 148 (shown in FIG. 13). The road 148 has a closer side 148.1 and a further side 148.2.

Figure 12:
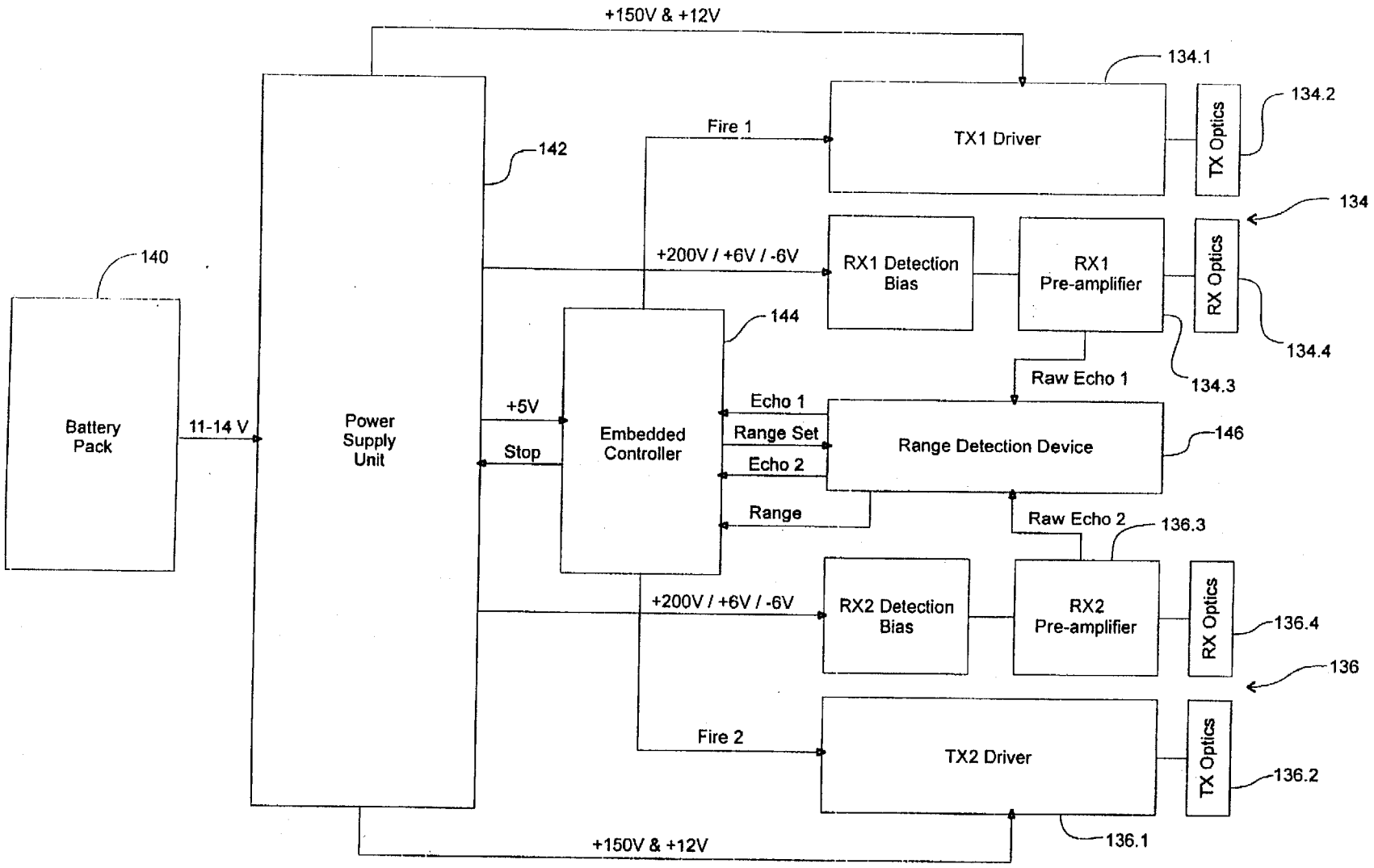
FIG. 12 is a block diagram of electro-optical components of the second embodiment of the vehicle counter according to the invention.

A block diagram of an electro-optical part of the second embodiment of the counter is shown in FIG. 12. The electro-optical part comprises a battery pack 140 connected to a power supply circuit 142. The power supply circuit 142 provides power to an embedded microprocessor based controller 144 and to the aforementioned first and second laser transmitter and receiver pairs 134 and 136 respectively.

The transmitter and receiver pairs are identical in all respects, so that only pair 134 will be described in more detail hereinafter.

As shown in FIG. 12, pair 134 comprises an infrared gallium arsenide laser diode transmitter 134.1 and suitable optics 134.2. The pair 134 further comprises an associated infrared silicon APD sensor 134.3 and suitable optics 134.4. The output of the sensor 134.3 is connected to a range detection device 146 which will be described in more detail hereinafter.

Figure 13:
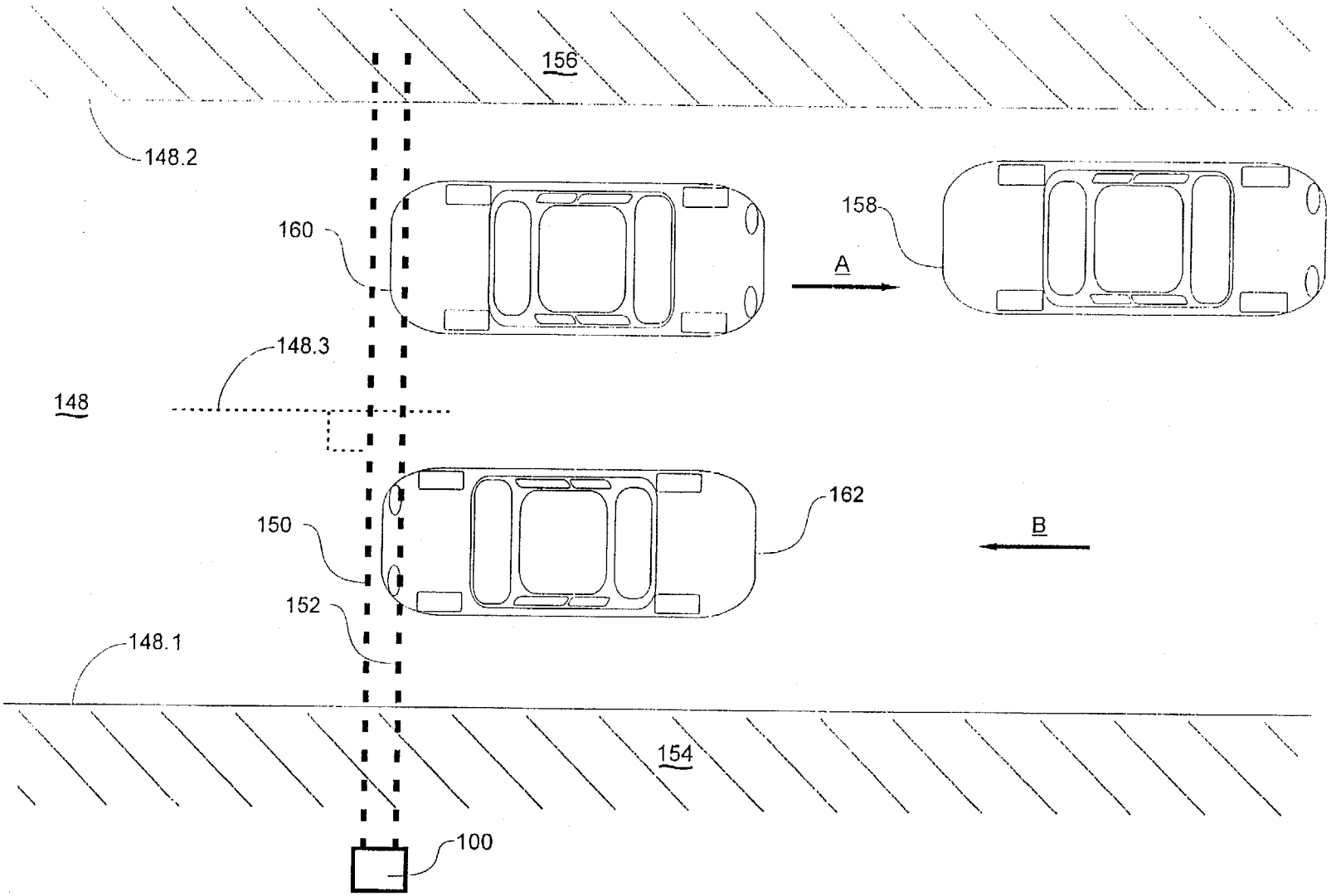
FIG. 13 is a plan view of a road and the distance-finding beams transmitted by the apparatus of the second embodiment.

The laser transmitters 134.1 and 136.1 are set up and aligned as illustrated in FIG. 13 to detect objects moving on road 148 in direction A or direction B. The tube 128 (shown in FIG. 10) is set up to extend substantially parallel to the centre line 148.3 of the road 148 shown in FIG. 13. The apparatus is sensitive only to objects travelling in a defined range extending between a minimum range boundary on the closer side 148.1 of the road 148 and a maximum range boundary on the further side 148.2 of the road, as will be described hereinafter.

Transmitter 134.1 transmits laser beams in a field having a centre axis 150. The laser signals are emitted in pulses at a frequency of about 1 KHz. Sensor 134.3 has a viewing field overlapping with the field of the transmitter in the aforementioned operational range. Similarly, the viewing field of sensor 136.3 overlaps with that of transmitter 136.1. The centre axis of the field associated with transmitter 136.1 is designated 152 in FIG. 13.

The maximum range, in use, of the counter is determined by filtering out all reflections received by sensors 134.3 and 136.3 from laser pulses emitted by transmitters 134.1 and 136.1 respectively having a time of flight longer than a maximum time of flight equal to the time of flight of a pulse transmitted from the relevant transmitter to the maximum range boundary 148.2 and back to the relevant sensor. Similarly the minimum range is determined by filtering out all reflections received by sensors 134.3 and 136.3 from laser pulses emitted by transmitters 134.1 and 136.1 respectively having a time of flight shorter than a minimum time of flight equal to the time of flight of a pulse transmitted from the relevant transmitter to the minimum range boundary 148.1 and back to the relevant sensor. This filtering is performed by the range detection device 146 (shown in FIG. 13) which allows through to controller 144 only those reflections in the raw echo signals received by the receivers 134.3 and 136.3 that have a time of flight intermediate the aforementioned minimum and maximum times of flight. Thus, in this manner reflections received from objects located or moving in the region 154 (shown in FIG. 13) between the apparatus and the minimum range boundary 148.1 and in the region 156 beyond the maximum range boundary 148.2, are not processed. It would be appreciated by those skilled in the art that the minimum and maximum range could be software adjustable. In other embodiments data relating to reflections from objects in regions 154 and 156 may be filtered out in the segmentation or pattern recognition steps.

Figure 14:
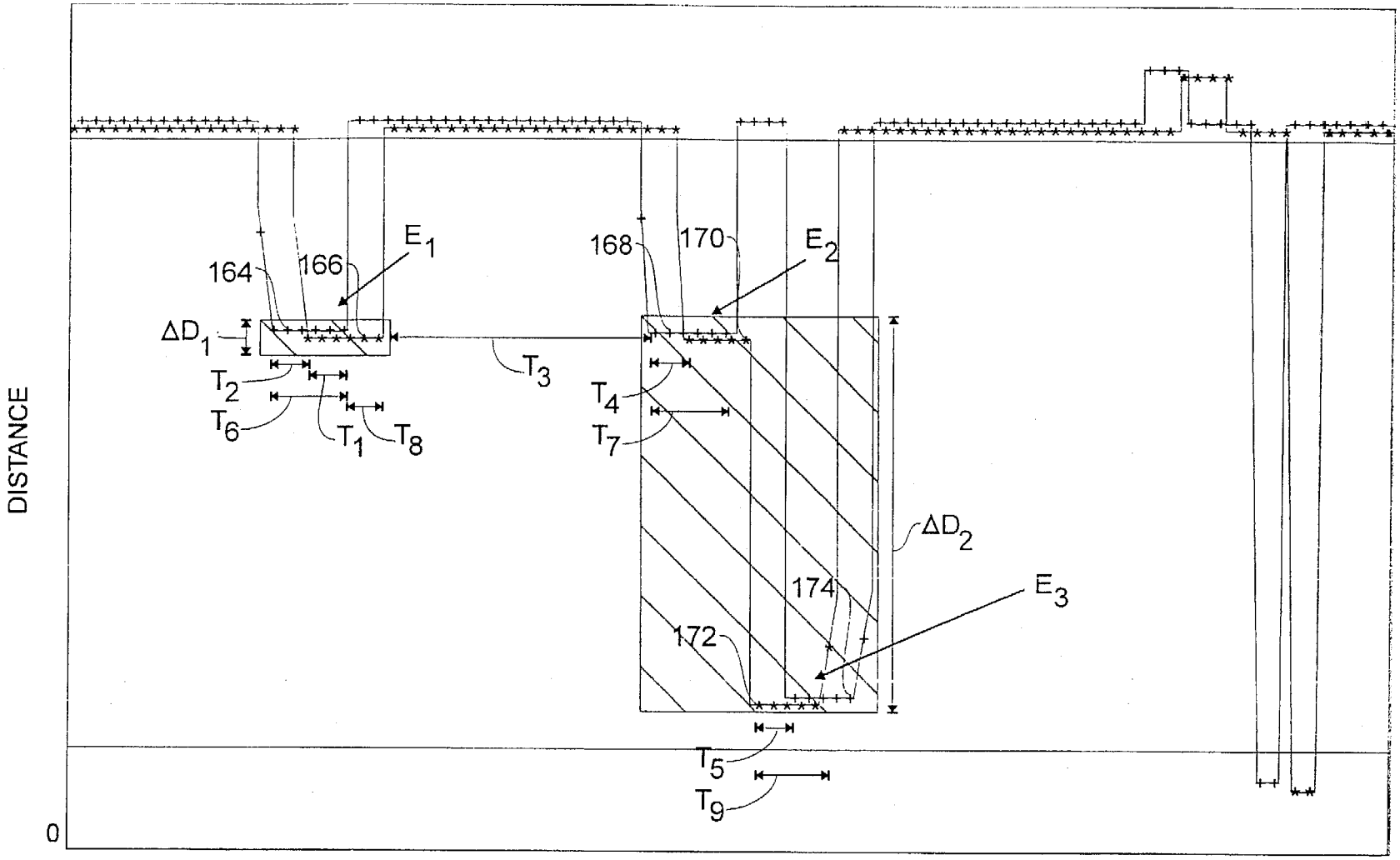
FIG. 14 is a two-dimensional pattern of distance from the distance-finder of the vehicles shown in FIG. 13, against time.

The resulting two-dimensional patterns for the vehicles 158 and 160 moving in direction A and vehicle 162 moving in direction B shown in FIG. 13, are shown in FIG. 14.

The leading vehicle 158 first reflects beams 150 and the resulting distance against time pattern is shown at 164 in FIG. 14. It then also reflects beams 152 as is indicated at 166. As is clear from the figure, for a time $T_1$ the vehicle is illuminated by both beams. The delay time between triggering the two beams is designated $T_2$.

Thereafter, vehicle 160 reflects the beams 150 as shown at 168 in the figure and thereafter it reflects beams 152, as shown at 170.

Shortly thereafter, vehicle 162 moving in direction B first reflects beams 152 as shown at 172 and thereafter beams 150, as shown at 174.

The complex pattern in FIG. 14 is segmented into classifiable events by using the non-detection of sensed objects over a predetermined minimum time period as one of the segmentation criteria. Since time period $T_3$ in FIG. 14 would exceed the said minimum time period, the pattern comprising lines 164 and 166 is segmented from the rest of the pattern as event $E_1$. Another segmentation criterium would be variation in distance ($\Delta D_1$ or $\Delta D_2$) within the pattern. If this variation exceeds a minimum variation (such as the case with $\Delta D_2$) the complex pattern may be further segmented into events $E_2$ and $E_3$.

In the pattern $T_2$, $T_4$ and $T_5$ indicate the time difference between the time of first triggering of sensor 134.3 and first triggering of sensor 136.3. In event $E_1$, $T_1>0$; in event $E_2$, $T_4>0$; and in event $E_3$, $T_5<0$. The times $T_6$, $T_7$ and $T_9$ indicate the difference between the time of first triggering and last triggering of the sensor first triggered.

The data relating to the aforementioned times is processed by the controller 144 (shown in FIG. 12) for event $E_1$ as follows:

First speed estimate=$D/T_2$ (where D is the spacing between the transmitter and receiver pairs)

Second speed estimate=$D/T_8$

First direction estimate travelling in direction A if $T_2>0$, else travelling in direction B.

Second direction estimate=travelling in direction A if $T_8>0$, else travelling in direction B.

Length estimate=speed estimate$\times T_6$.

The said length estimate may be used to determine whether the vehicle is a long and therefore a heavy vehicle or short and therefore a passenger car or the like. Other objects which may not be of interest, such as pedestrians and animals, could be filtered out by using this estimate as a criterion.

Events $E_1$ and $E_2$ are classified as passenger cars travelling relatively fast in direct A, while event $E_3$ is classified as a passenger car travelling at substantially the same speed in direction B in a lane closer to the apparatus 100.

Figure 11:
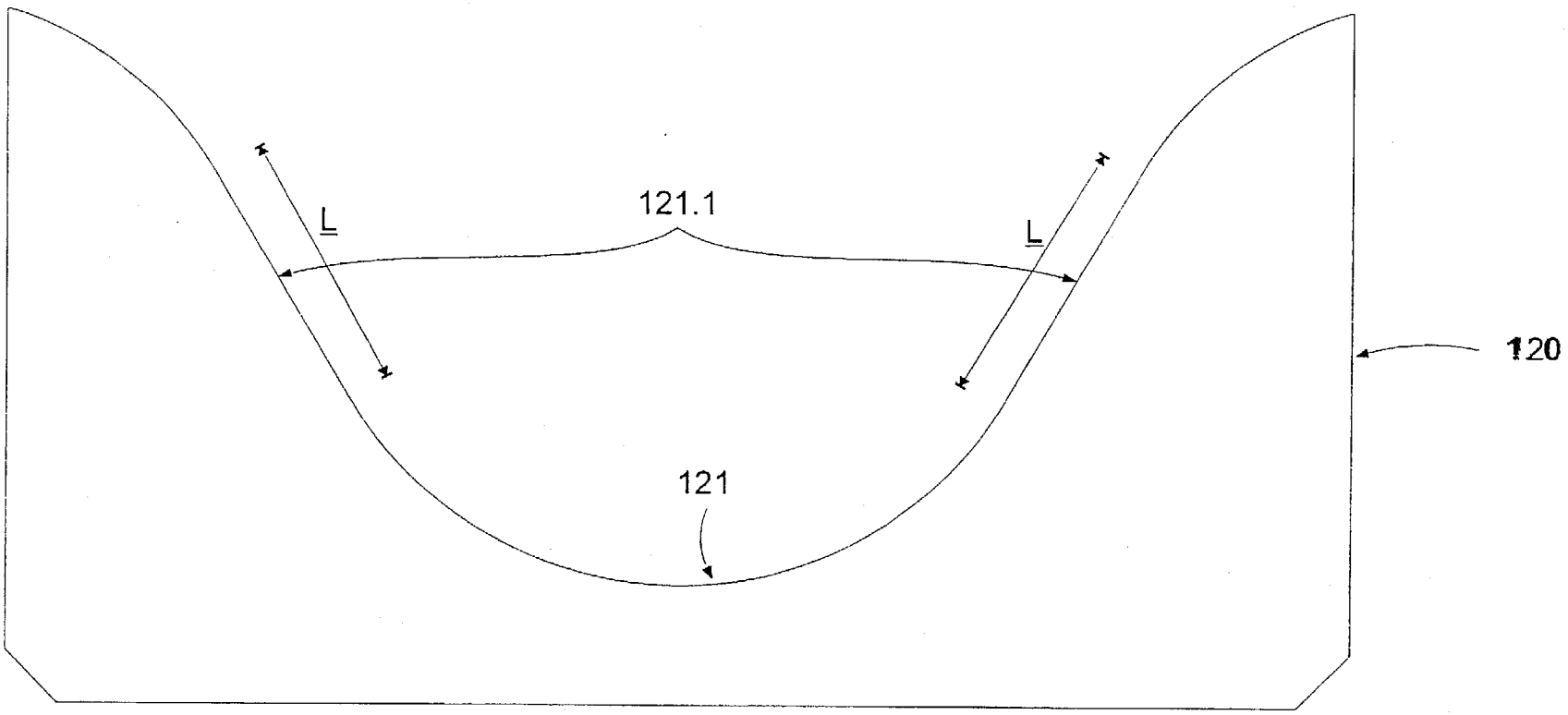
FIG. 11 is a plan view of a saddle arrangement forming part of the apparatus in FIG. 10 and illustrating its profile.

In another form of the invention, an arrangement similar to that described with reference to FIGS. 10, 11 and 12 may be used, with the exception that in this other form, mere presence of the vehicle in a defined range within an operative region is detected and not the exact range of the vehicle as such, as in the case of the two embodiments described hereinbefore.

Figure 15:
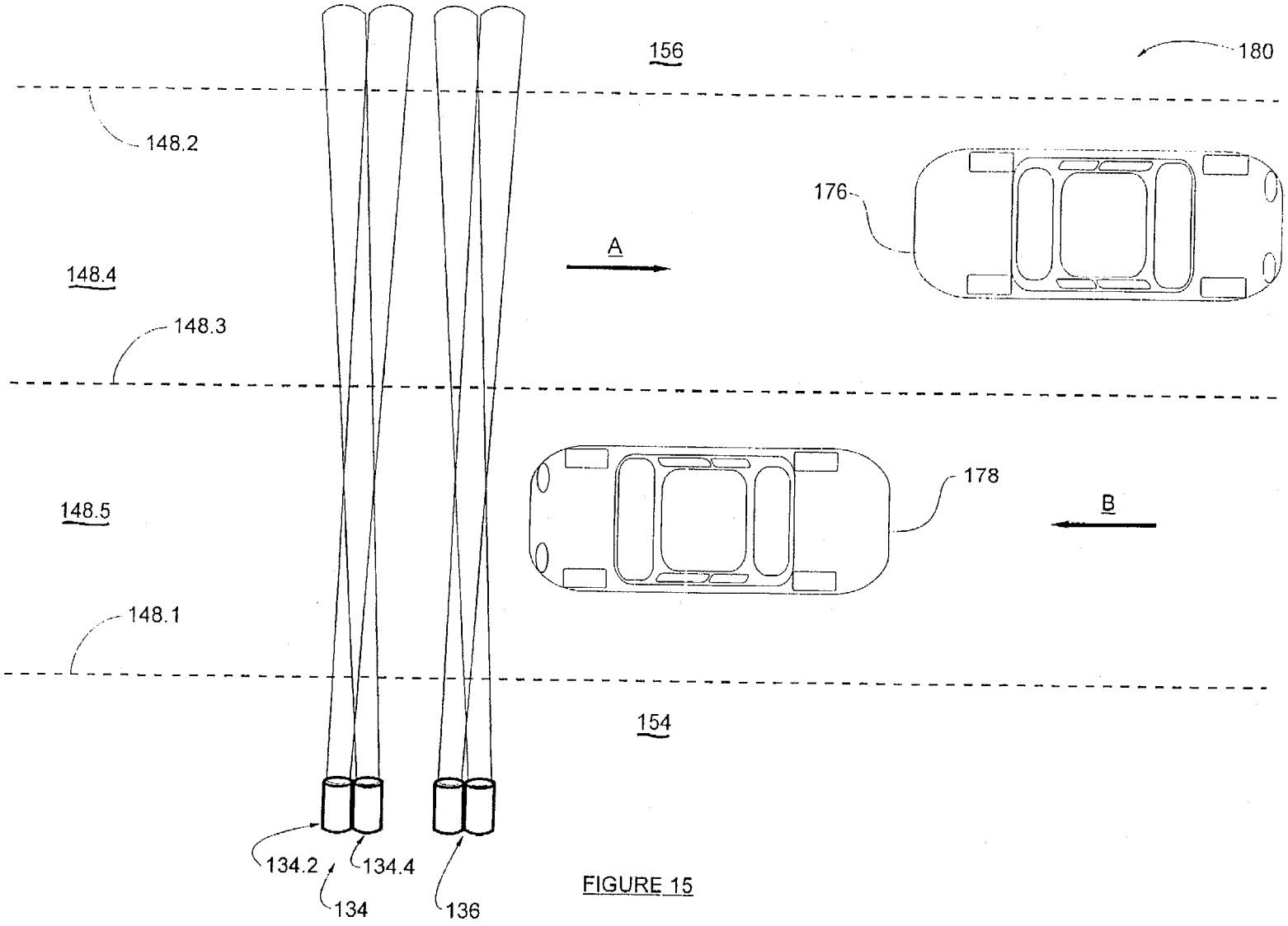
FIG. 15 is a plan view of a road and the distance-finding means transmitted by apparatus according to a second form of the invention.

As shown in FIG. 15, in this latter case, road 148 in operative region 180 is divided into two ranges namely lane 148.4 and lane 148.5 on either side of centre line 148.3. Vehicle 176 travels in direction A in lane 148.4 and vehicle 178 travels in direction B in lane 148.5.

Figure 16:
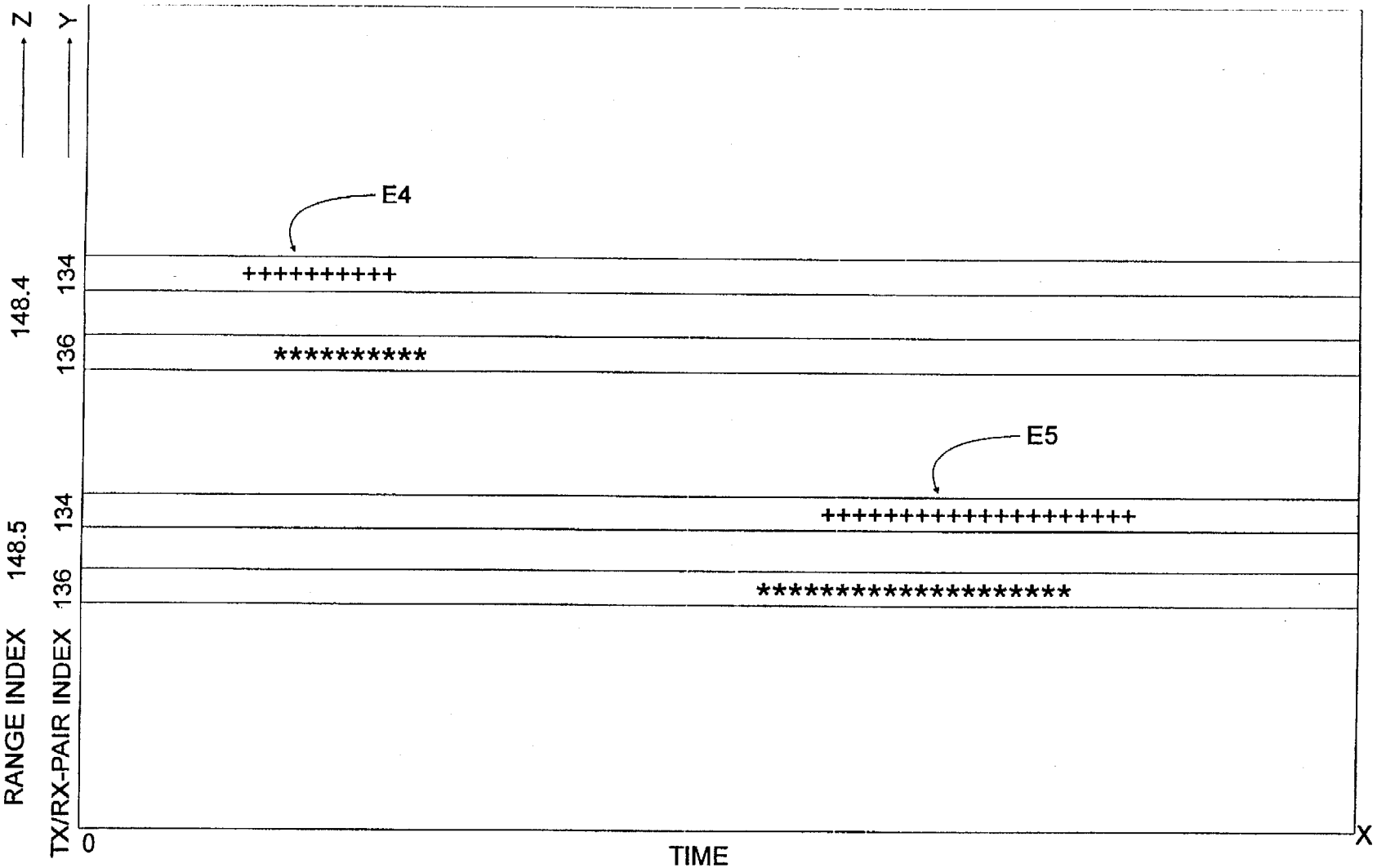
FIG. 16 is a three-dimensional pattern representing the vehicles in FIG. 15 wherein a first dimension is time, a second dimension is transmitter and receiver pair index and a third dimension is range index.

As shown in FIG. 16, a three-dimensional pattern is generated by the signal generator wherein the first or x-dimension is time, the second or y-dimension is transmitter receiver pair index (134 and 136) and the third or z-dimension range index (148.5 and 148.4). By means of the filtering techniques described hereinbefore data regarding objects in regions 154 and 156 outside the minimum and maximum ranges 148.1 and 148.2 are filtered out.

Vehicle 176 is first detected by transmitter receiver pair 134 and thereafter by transmitter receiver pair 136. The vehicle is detected in the range of lane 148.4 and the resulting pattern is designated $E_4$.

Vehicle 178 is first detected by transmitter receiver pair 136 and thereafter by pair 134. Vehicle 178 is detected in the range of lane 148.5 and the resulting pattern is designated $E_5$. The events $E_4$ and $E_5$ are segmented by the segmentation means based on their spacing in the time domain and the range index.

Suitable features of the patterns are extracted and fed to the neural net 38 (shown in FIG. 1 ) which is trained to classify event $E_4$, on the same basis as that described with reference to FIG. 14, as a vehicle travelling relatively fast in lane 148.4 in direction A. Similarly event $E_5$ would be classified as a vehicle travelling relatively slowly in line 148.5 in direction B. The output of the neural net 38 is connected to counter 40 which counts vehicles of different kinds moving in any one of directions A or B.

It will be appreciated that there are many variations in detail on the apparatus and method according to the invention without departing from the scope and spirit of the appended claims.

We claim:

1. Apparatus for classifying movement of an object moving in a defined range within an operative region, the apparatus comprising:

distance-finding means mountable adjacent said operative region;

the distance finding means comprising transmitter means for transmitting stationary beams of electromagnetic waves along a given stationary field extending through said operative region;

receiver means located adjacent said transmitter means for receiving reflections of said beams from regions on an object moving in said operative region through said field, to determine from said reflections the presence or absence of the object in the range, said moving object being representative of one of a plurality of different classes;

controller means connected to the distance-finding means for causing the distance-finding means over a period of time to illuminate regions on the object with the beams and to determine from reflections of the beams from the regions a sequence of data relating to the presence or absence of the object in the range as the object moves along the operative region, for gathering data relating to the time relation of the sequence of data and for filtering out data regarding objects in the operative region but outside of said range;

the controller means further comprising signal generating means responsive to said reflections for generating a multi-dimensional pattern representing said object moving in the range wherein said multi-dimensional pattern has a first dimension in the time domain; and pattern recognition means connected to the signal generating means to receive as an input said pattern and for classifying the pattern according to one of said plurality of different classes and for providing a corresponding output signal.

2. Apparatus as claimed in claim 1 wherein the distance-finding means includes means for determining from said reflections the distance of said regions on the object from a reference and wherein said data relating to presence or absence of the object comprises a sequence of distance data relating to the distance of the said regions on the object from the reference as the object moves through the field; and wherein a second dimension of said multi-dimensional pattern comprises the distance from the reference.

3. Apparatus as claimed in claim 1 wherein the distance-finding means includes a range gate and the defined range extends between a first boundary and a second boundary and wherein the controller means comprises filter means for filtering out data relating to reflections received from objects beyond the second boundary, constituting a maximum range of the range gate.

4. Apparatus as claimed in claim 3 wherein the distance-finding means is located adjacent but spaced from the said first boundary and wherein the controller means further comprises further filter means for filtering out data relating to reflections received from objects between the distance-finding means and said first boundary constituting a minimum range of said range gate.

5. Apparatus as claimed in claim 1 wherein the distance-finding means utilizes time of flight of a pulse transmitted by the transmitter means towards a region on the object from where it is reflected and back to the receiver means, to determine the distance of said regions on the object from the reference.

6. Apparatus as claimed in claim 1 comprising segmentation means connected to said signal generating means to receive said multi-dimensional pattern as an input and for segmenting the pattern into classifiable events.

7. Apparatus as claimed in claim 6 wherein the segmentation means segments the pattern by fitting geometrical masks onto the pattern.

8. Apparatus as claimed in claim 1 wherein the pattern recognition means comprises a neural net.

9. Apparatus as claimed in claim 1 wherein the transmitter means comprises a single transmitter for transmitting beams in a single field, the field having a center axis which is at an angle of less than 90° relative to an elongate axis of the operative region.

10. Apparatus as claimed in claim 1 wherein the transmitter means comprises first and second transmitters and the receiver means comprises first and second receivers constituting first and second transmitter and receiver pairs, the pairs being spaced from one another to transmit beams in first and second fields having a first and a second, center axis respectively, the first and second axes being substantially parallel to one another substantially perpendicular to an elongate axis of the operative region, and wherein the signal generating means generates the multi-dimensional pattern from data received from both said first and second pairs.

11. Apparatus as claimed in claim 10 wherein the first and second transmitter and receiver pairs are pivotably mounted in a housing to adjust the elevation of the first and second transmitter and receiver pairs and wherein the housing is mountable on a support structure.

12. Apparatus as claimed in claim 11 wherein the housing comprises a saddle arrangement for abutting against a support on which the housing is mounted.

13. Apparatus as claimed in claim 12 wherein the saddle arrangement defines a slot having a bell-shaped profile.

14. Apparatus as claimed in claim 13 wherein the bell shaped profile comprises opposed linear regions in regions thereof spaced from an apex of the profile.

15. Apparatus as claimed in claim 11 wherein the housing comprises a cover which is removably mountable on a back plate and wherein the housing defines a window region for the first and second transmitter and receiver pairs.

16. Apparatus as claimed in claim 1 wherein the operative region has an elongate axis, the transmitter means comprises first and second transmitters and the receiver means comprises first and second receivers constituting first and second transmitter-receiver pairs, each pair being associated with a unique transmitter-receiver pair index, the pairs being spaced from one another to transmit beams in first and second fields having first and second center axes respectively extending transversely to the elongate axis of the operative region; and wherein the signal generating means includes means for generating from data received from both said first and second transmitter and receiver pairs the multi-dimensional pattern, having a first dimension in the time domain and a second dimension comprising the transmitter-receiver pair index.

17. Apparatus as claimed in claim 16 wherein the operative region is divided into at least first and second defined ranges each associated with a unique range index and wherein the multi-dimensional pattern is a three dimensional pattern and wherein the third dimension is range index.

18. A method of classifying objects moving in a defined range within an operative region, the method comprising the steps of:

illuminating an object moving in the operative region with a sequence of pulses transmitted along a given stationary path from a distance-finding means adjacent said operative region, said object being representative of one of a plurality of different classes and causing reflections of said pulses;

receiving said reflections of said pulses at said distance-finding means;

filtering out data from those received reflections from objects outside of said range;

generating a multi-dimensional pattern from said reflections and representing said object moving in the range wherein said pattern has a first dimension in the time domain;

classifying said pattern according to one of said plurality of different classes; and providing an output signal corresponding to said classified pattern.

19. A method as claimed in claim 18 comprising the step of determining from said transmitted pulses and said reflections the distance of regions on the object from a reference and wherein the step of generating a multi-dimensional pattern comprises generating a two dimensional pattern representing the object having a second dimension comprising distance from the reference.

20. A method as claimed in claim 18 wherein the operative region is divided into at least a first and a second range each associated with a unique range index wherein said distance-finding means comprises at least first and second transmitter and receiver pairs each associated with a unique transmitter receiver pair index, said pairs for illuminating the object with said -pulses and to receive reflections, wherein said pulses and said reflections are utilized to determine whether the object is in said first or said second range and wherein the step of generating a multi-dimensional pattern comprises generating a three dimensional pattern representing the object having a first dimension in the time domain, a second dimension comprising transmitter receiver pair index and a third dimension comprising range index.

21. A method of classifying objects moving in a defined range within an operative region divided into at least a first and a second range each associated with a unique range index, the method comprising the steps of:

illuminating an object moving in the operative region with a sequence of transmitted pulses from a distance-finding means adjacent said operative region, said object being representative of one of a plurality of different classes and causing reflections of said pulses;

receiving said reflections of said pulses at said distance-finding means;

generating a multi-dimensional pattern representing said object moving in the range;

classifying said pattern according to one of said plurality of different classes; and providing an output signal corresponding to said classified pattern;

said distance-finding means comprising at least first and second transmitter and receiver pairs each associated with a unique transmitter receiver pair index, said pairs for illuminating the object with said pulses and to receive reflections, determining by utilizing said reflections and pulses whether the object is in said first or said second range and wherein the step of generating a multi-dimensional pattern comprises generating a three dimensional pattern representing the object having a first dimension in the time domain, a second dimension comprising transmitter receiver pair index and a third dimension comprising range index.

22. Apparatus for classifying movement of a plurality of objects, each object moving in a different one of a plurality of parallel paths, said paths each defining a corresponding different range within an operative region, the apparatus comprising:

distance-finding means adjacent to said operative region and comprising transmitter means for transmitting beams of electromagnetic radiation through said operative region and said paths, said paths each at a corresponding different distance to said distance-finding means;

receiver means located adjacent said transmitter means for receiving reflections of said beams from regions of each object moving in said operative region along said paths, to determine from said reflections the presence or absence of an object in the range of a corresponding selected path, said moving object in the selected path being representative of one of a plurality of different classes;

controller means connected to the distance-finding means for causing the distance-finding means over a period of time to illuminate regions on the objects moving on said paths within said ranges with the beams and to determine from reflections of the beams from the illuminated regions a sequence of data relating to the presence or absence of an object in the corresponding range of the selected path as that object moves along the operative region, for gathering data relating to the time relation of the sequence of data and for filtering out data regarding objects moving in the operative region outside of said selected path range;

the controller means further comprising signal generating means responsive to said reflections for generating a multi-dimensional pattern representing said object moving in the range of the selected path wherein said multi-dimensional pattern has a first dimension in the time domain; and pattern recognition means to read to the signal generating means to receive as an input said pattern and for classifying the pattern according to one of said plurality of different classes and for providing a corresponding output signal.

* * * * *

UNITED STATES PATENT AND TRADEMARK OFFICE

CERTIFICATE OF CORRECTION

PATENT NO. : 5,752,215
DATED : May 12, 1998
INVENTOR(S) : Zaaiman, et al

It is certified that error appears in the above-indentified patent and that said Letters Patent is hereby corrected as shown below:

Column 14, line 12, change "to read" to -- connected--.

Signed and Sealed this

Eighteenth Day of August, 1998

Bruce Lehman

*Attest:*

BRUCE LEHMAN

*Attesting Officer*

*Commissioner of Patents and Trademarks*